United States Patent [19]

Harris

[11] 4,380,037

[45] Apr. 12, 1983

[54] ELECTROSTATIC TREATMENT OF PAPER

[75] Inventor: William D. Harris, Greensboro, N.C.

[73] Assignee: Burlington Industries, Inc., Greensboro, N.C.

[21] Appl. No.: 264,697

[22] Filed: May 18, 1981

[51] Int. Cl.[3] ..... H05F 3/00

[52] U.S. Cl. ..... 361/214; 361/212

[58] Field of Search ..... 361/214, 212; 271/208, 271/18.1

[56] References Cited

U.S. PATENT DOCUMENTS

| | | | |
|---|---|---|---|
| 687,932 | 12/1901 | Colby | 361/214 |
| 1,099,799 | 6/1914 | Heiny . | |
| 1,572,352 | 2/1926 | Ewalt | 361/214 X |
| 2,473,751 | 6/1949 | Johnson | 271/18 |
| 3,271,483 | 9/1966 | Phillipson et al. | 264/24 |
| 3,272,505 | 9/1966 | Sanderson | 271/71 |
| 3,565,420 | 2/1971 | Howard | 271/4 |
| 3,671,806 | 6/1972 | Whitmore et al. | 361/214 |
| 3,826,379 | 7/1974 | Wright | 271/208 |
| 3,865,480 | 2/1975 | Swanberg | 355/3 R |
| 4,073,001 | 2/1978 | Stange | 361/214 |

*Primary Examiner*—Reinhard J. Eisenzopf

*Attorney, Agent, or Firm*—Cushman, Darby & Cushman

[57] ABSTRACT

Method and apparatus for altering the static electric charges of sheets of dielectric material arranged in a stack in which the stack is subjected to a high intensity electrostatic gradient. Interlock and shorting structures are utilized for preventing injury to users due to electrical shock.

7 Claims, 4 Drawing Figures

ELECTROSTATIC TREATMENT OF PAPER

BACKGROUND AND SUMMARY OF THE INVENTION

This application relates generally to a method and apparatus for removing electrostatic charges from sheets of dielectric material arranged in a stack. Such a method and apparatus are particularly useful for removing the electrostatic charges which may accumulate on sheets of paper during processes such as high speed printing and electrostatic copying.

Certain processes have a tendency to transfer relatively large electrostatic charges to the surfaces of dielectric material. Such surface charges can have the undesirable effect of hindering subsequent attempts to separate or otherwise arrange stacked sheets of the dielectric material. An example of such a problem frequently arises in the fields of electrostatic copying and high speed printing. Paper, emerging from a photocopier or high speed printer, often bears large electrostatic surface charges. Once such paper has been stacked, it is almost impossible to "jog" the edges of the paper into alignment until the accumulated charges have leaked off. This may take hours, or even days, and undesirably prolongs overall processing time.

Many papers, such as fold-form paper passing through a laser printing system, have an extremely strong positive charge. The charge may remain within the stack for hours to days, and greatly hinders subsequent jogging of the papers into alignment since random negative surface charges are imparted to the sheets during handling causing some adjacent sheets to have a strong attraction to each other. According to the present invention, by the application of a high negative potential to the entire stack, electrons are forced into the stack filling the absence of electrons created in previous processing (which created the positive charge). Once the positive charge is eliminated, there are no electrical attractive forces acting between adjacent sheets in the stack. The sheets may then be successfully jogged (in any suitable conventional manner) immediately after treatment, with about a 15% increase in jogging production.

The present invention provides in general a method and apparatus for simultaneously altering accumulated static electric charges on sheets of dielectric material, such as paper, arranged in a stack. This is accomplished in the present invention by subjecting the stack of paper to an extremely strong potential gradient. It has been found that such treatment completely depletes opposite polarity electrostatic charges on the stacked sheets of paper, thus facilitating subsequent handling operations. Treating an entire stack of paper is quicker and more efficient that individually treating separate sheets of paper, and is accomplished simply according to the invention. These and other advantages of the invention will become more readily apparent from the following detailed description of the presently preferred exemplary embodiments, taken together with the accompanying drawing.

DETAILED DESCRIPTION OF THE PREFERRED EMBODIMENT

Figure 1:
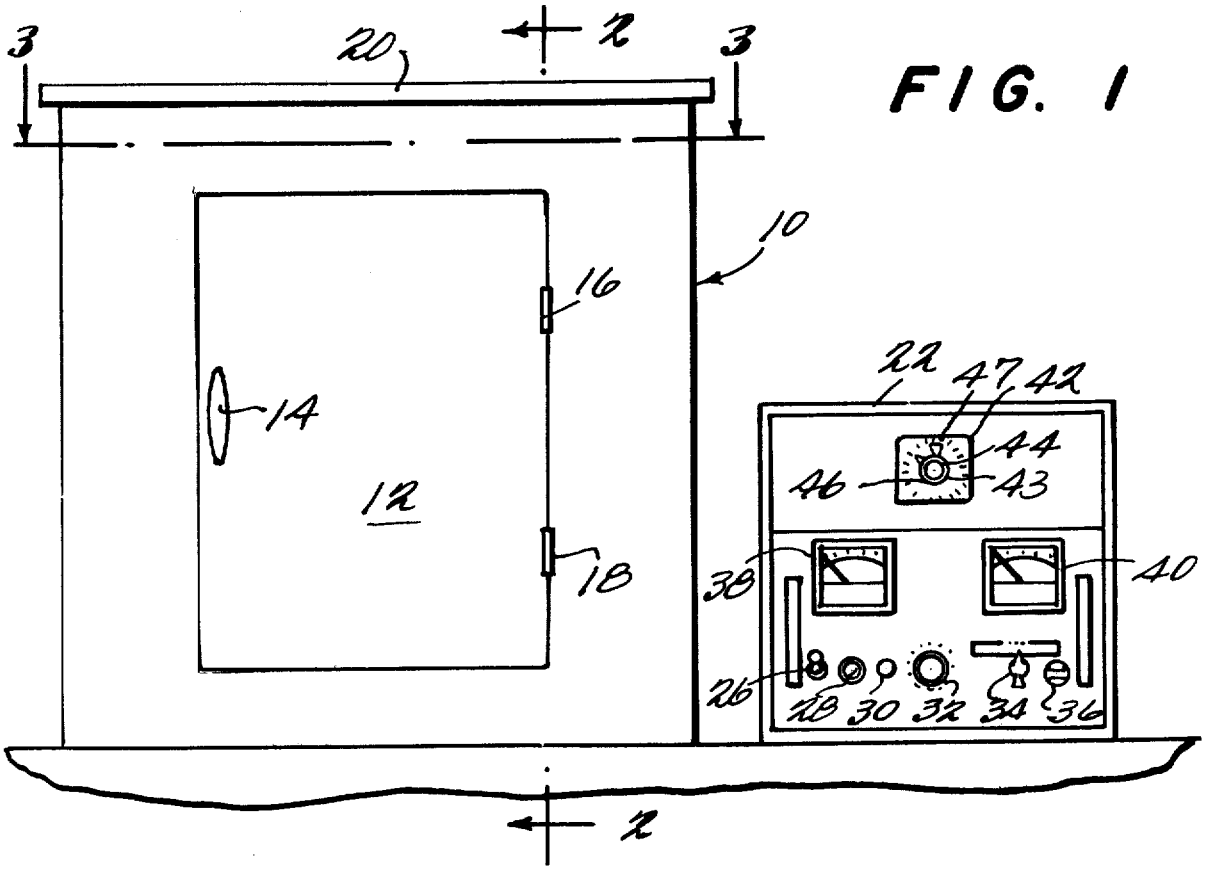
FIG. 1 is a front view of an exemplary apparatus for removing electrostatic charges from stacks of paper according to the present invention.

Referring first to FIG. 1, an apparatus for removing electrostatic charges from paper according to the present invention comprises an enclosure 10 having a door 12. In the presently preferred embodiment, enclosure 10 is roughly cubical with an edge length of about 36 inches. Enclosure size and configuration can be changed as desired according to how large a stack is to be treated, as long as components inside of enclosure 10 to be described below are sufficiently removed from one another to prevent high voltage arcing effects. The door 12 has a handle 14 and hinges 16 and 18. Enclosure 10 may also be provided with a lid 20 for permitting access to the interior of enclosure 10 through its top.

A separate enclosure 22 contains the means for applying a high voltage gradient to a stack of paper placed within enclosure 10. It will be obvious to one skilled in the art that any suitable commercially available high voltage power supply with or without incorporated switches and meters will suffice for this application. In the presently preferred embodiment, the enclosure 22 contains a high voltage supply 24 having an off/on switch 26, indicator light 28, and power fuse 30. High voltage supply 24 also incorporates a voltage adjustment dial 32, voltmeter polarity switch 35, and an overload fuse 36. The system output polarity is not affected by the switch on the front panel, although the polarity may be changed internally by connector reversal. A volt meter 38 and a milliammeter 40 are also incorporated into high voltage supply 24. The high voltage supply used in the presently preferred embodiment has an operating range of 0–60 KV. Above 60 KV the corona discharge is very difficult to contain, or control.

Also contained in enclosure 22 is high voltage supply timer control 42 which controls line power (115 VAC) to high voltage supply 24. Timer control 42 has a center dial 43 having an inner part 44 and outer part 46. Depression of center part 44 activates power supply 24 for an interval of time preselected by means of outer part 46. In the presently preferred embodiment, timer control 42 is a sixteen minute maximum range timer settable in one-half minute intervals. An indicator lamp 47 indicates operation of timer control 42.

Figure 2:
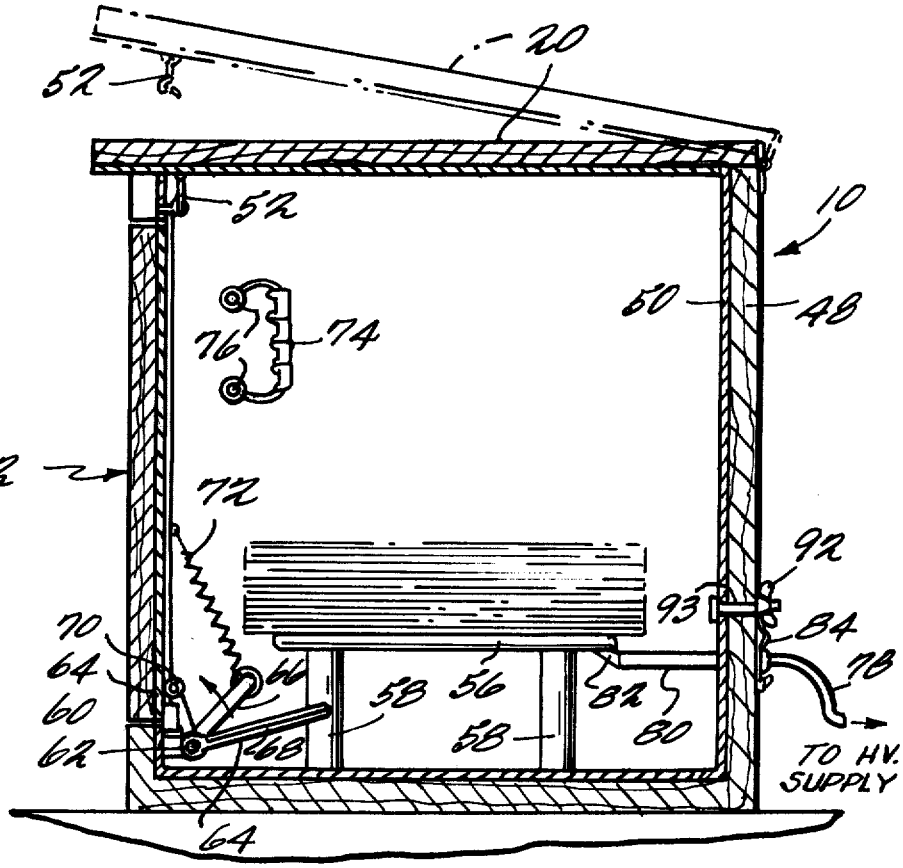
FIG. 2 is a side cutaway view taken along line 2 in FIG. 1 of the enclosure used in the treatment of stacks of paper according to the subject invention.

Turning now to FIG. 2, the interior elements of enclosure 10 can now be seen. Specifically, it can be seen that the walls of enclosure 10 are of two layers, an exterior layer 48 and an interior layer 50. Exterior layer 48 is made of insulating material. The preferred embodiment uses one-half inch plywood. Interior layer 50 is made of a conducting material such as sheet aluminum. One skilled in the art will readily appreciate that the entire enclosure may be fabricated from aluminum or other conductive metal, although this would be more costly than the choice of materials in the presently preferred embodiment.

Also in FIG. 2, one can see lid 20 drawn in phantom in a partially opened position. Lid 20 has attached to it hooks 52, which hook into eyelets 54 disposed in the interior of enclosure 10.

Also inside enclosure 10 is treatment platform 56. In the presently preferred embodiment, treatment platform 56 is an electrically conductive plate measuring about 18×18×⅛ inches. This plate may be of any desirable size as long as its edges are sufficiently distant from the interior of enclosure 10. Also, the edges of treatment platform 56 must be rounded to reduce high voltage arcing effects. Treatment platform 56 is supported by four insulating posts 58. The insulating posts 58 in the presently preferred embodiment are comprised of ceramic and are about 7½ inches high. Their height is selected to prevent arcing between treatment platform 56 and the floor or enclosure 10.

Enclosure 10 also contains door actuated roller mechanism 60. Door actuator roller mechanism 60 is comprised of a pivot 62, on which turns arms 64 and 66 and shorting arm 68. Arm 64 is provided with roller 70 which frictionally engages door 12. Arm 66 is attached to spring 72 which is also connected to the interior of enclosure 10. Spring 72 tends to pull the end of arm 66 remote from pivot 62 towards the interior of enclosure 10. Shorting arm 68 bears a high voltage cable 69. Arms 64 and 66 and shorting arm 68 are rigidly interconnected so that shorting arm 68 does not contact treatment platform 56 when door 12 is closed, but places cable 69 in contact with platform 56 when door 12 is open.

Cable 69 is electrically connected to resistor 74, which is disposed in the interior of enclosure 10 on insulating posts 76. The other end of resistor 74 is connected to ground. Platform 56 is connected to the high voltage supply through coaxial cable 78. The sheathing of coaxial cable 78 is connected at one end to the interior 50 of enclosure 10 and at the other end to ground. The center conductor of coaxial cable 78 is guided to treatment platform 56 through pipe 80. Pipe 80 is comprised of electrically insulative material. Pipe 80 is secured to treatment platform 56 by an encircling outer circumference of the female pipe connector 82. Cable 78 is secured to the exterior of enclosure 10 by bracket 84 by wing nut means 92 electrically connected to an internal shield by a through bolt 93. A center conductor of coaxial cable 78 plugs into the inner circumference of copper pipe 82.

Figure 3:
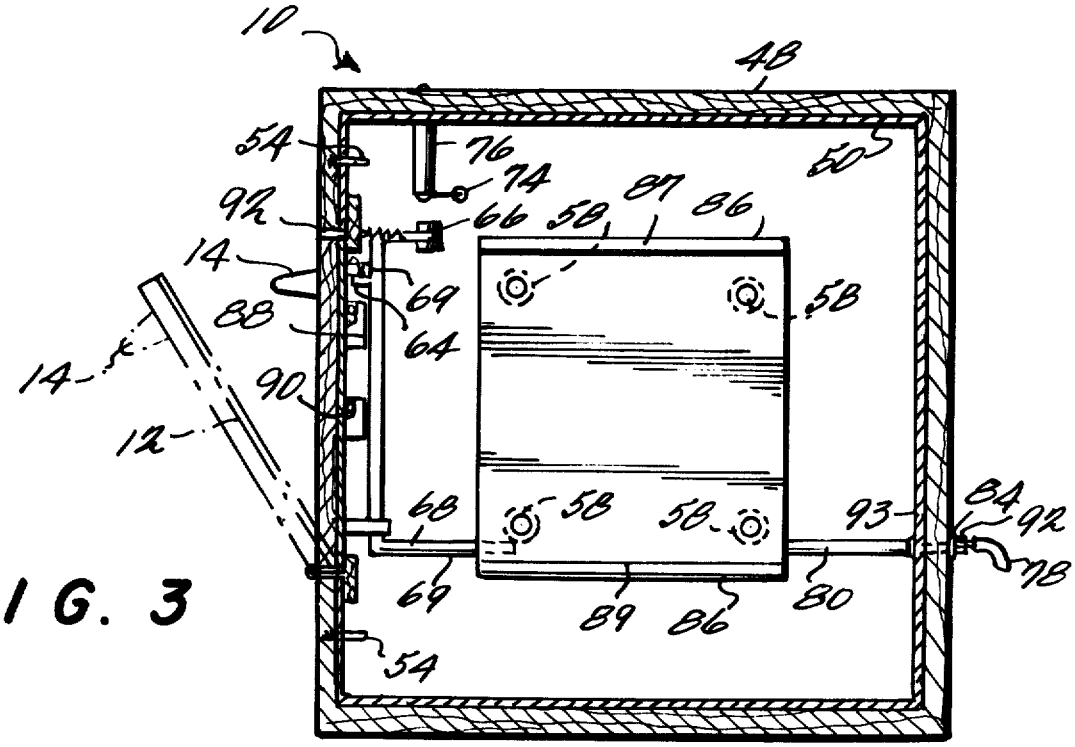
FIG. 3 is a top cutaway view taken along line 3 in FIG. 1 of the enclosure of FIG. 2.

As seen in FIG. 3, edges 87 and 89 of treatment platform 56 are provided with polyethylene sleeves 86 to prevent the effects of corona discharge. In the preferred embodiment, sleeves 86 are slit polyethylene tubing secured to edges 87 and 89 with a silicon-based adhesive. Also visible in FIG. 3 are microswitches 88 and 90 which are open when door 12 is open and closed when door 12 is closed. Electrically, these microswitches are interposed between timer control 42 and high voltage supply 24. Also visible in FIG. 3 are magnetic door latches 92.

Figure 4:
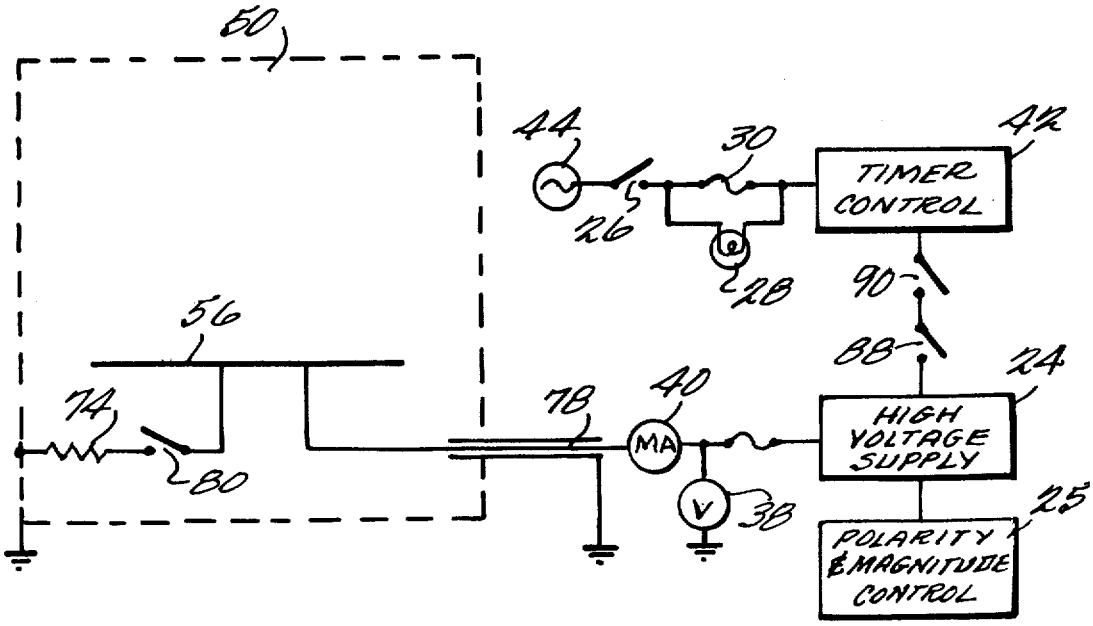
FIG. 4 is a schematic diagram of apparatus for removing electrostatic charges on stacked pieces of paper according to the subject invention.

The electrical connection between various components is most readily perceived in FIG. 4. A line voltage source 94 is connected to timer control 42 through on/off switch 26, to indicator lamp 28, and fuse 30. Timer control 42 is connected to the adjustable high voltage supply 24 through microswitches 90 and 88. High voltage supply 24 is connected to treatment platform 56 through fuse 36, milliammeter 40, and coaxial cable 78. Polarity and magnitude control 25, controlled by voltage adjustment dial 32, and polarity switch 35 in FIG. 1, is connected to high voltage supply 24. High voltage meter 38 is connected in parallel with treatment plate 56. When switch 80, corresponding to shorting arm 68, is closed, treatment plate 56 is also connected to ground through resistor 74. Interior surfaces 50 of enclosure 10 are connected to ground and serve as both opposing electrodes and shield for platform 56.

In use, an apparatus for removing electrostatic charges from paper arranged in stacks according to the present invention operates as follows. Door 12 is opened and the stack of papers is placed within enclosure 10 atop platform 56, care being taken not to allow too much overlap of the plate 56 with the edges of the sheets [the overlap cannot be great enough to permit breakdown of the dielectric—paper—and arcing to the inside of the enclosure]. While door 12 is open, shorting arm 68 contacts it, thus draining off any charge which may reside on the plate due to previous charging operations. Also, microswitches 88 and 90 are open thus disabling high voltage supply 24 and protecting the user from the hazard of electric shock.

Once the stack of papers has been properly positioned atop plate 56, door 12 is closed. Door 12 is retained in the closed position by magnetic latches 92. Closing door 12 closes microswitches 88 and 90. Then inner part 44 of center dial 43 of high voltage supply timer control 42 is depressed, thus activating high voltage supply 24 for a period of time preselected by use of outer part 46. This time period depends on stack height and type of paper. To discharge the charges on an eight inch stack of computer form paper, for example, the stack is subjected to 55 kilovolts for four minutes. If a smaller stack is used, less time is required. After the preselected amount of time, high voltage timer control 42 deactivates high voltage supply 24. The stack of paper is then removed, having been rendered more susceptible to manipulation in subsequent handling operations.

Although only one embodiment of the invention has been described in detail above, those skilled in the art will readily appreciate that many modifications are possible without departing from the novelty teachings and advantages of this invention. Accordingly, all such modifications are intended to be included within the scope of this invention as defined by the following claims.

What is claimed is:

1. A method of altering electrostatic charges of sheets of dielectric material arranged in a stack, utilizing a plate comprised substantially of electrically conductive material inside an enclosure having electrically conductive interior surfaces, the plate being electrically insulated from the interior surfaces, comprising the steps of:

(a) placing one sheet of the stack in operative association with the plate, while maintaining the rest of the sheets of the stack free from contact with any electrically conductive manner;

(b) electrically connecting the interior surfaces to a first voltage; and (c) electrically connecting the plate to a second voltage, much greater than the first voltage, long enough to alter the electrostatic charges.

2. A method as recited in claim 1 wherein the plate is horizontal and wherein step (a) is practiced by placing the stack atop the plate with one face of the bottom sheet on the plate, and so that the edges of sheets in the stacks have insufficient overlap of the sides of the plate to allow arcing from the plate.

3. A method as recited in claim 1 or claim 2 wherein steps (b) and (c) are practiced by electrically connecting structures to continuous single polarity voltage sources.

4. An apparatus for altering electrostatic charges of sheets of dielectric material arranged in a stack comprising:

an enclosure, said enclosure including a door, and electrically conductive interior surfaces electrically connected to ground;

a treatment plate comprised substantially of electrically conductive material within said enclosure and having rounded edges;

means connected to said plate for preventing high voltage arcing effects;

electrically insulating means connected between said treatment plate and said enclosure for retaining said treatment plate at a fixed distance from said interior surfaces;

means connected to said enclosure for electrically connecting said treatment plate to ground when said door is open;

a high voltage supply connected to said treatment plate;

means connected to said high voltage supply for actuating said high voltage supply; and interlock means attached to said enclosure, and connected between said activating means and said high voltage supply for permitting said activating means to activate said high voltage supply only when said door is closed.

5. An apparatus as claimed in claim 4 wherein said enclosure further includes means for permitting access to its interior through its top.

6. An apparatus as claimed in claims 4 or 5 wherein said actuating means further includes means for preselecting the duration of the interval of time for which said high voltage supply will remain actuated.

7. An apparatus as recited in claims 4 or 5 wherein said plate comprises a horizontal platform having a surface area greater than that of sheets of dielectric material to be placed thereon.

* * * * *